United States Patent [19]

Johnston et al.

[11] Patent Number: 4,533,790

[45] Date of Patent: Aug. 6, 1985

[54] ELECTRICAL CONDUCTOR ASSEMBLY

[75] Inventors: James J. Johnston, Old Saybrook; Gregory L. Glynn, Mansfield Center, both of Conn.

[73] Assignee: Akzona Incorporated, Ashville, N.C.

[21] Appl. No.: 589,169

[22] Filed: Mar. 13, 1984

Related U.S. Application Data

[63] Continuation-in-part of Ser. No. 466,833, Feb. 16, 1983, abandoned.

[51] Int. Cl.[3] ..... H01B 7/00

[52] U.S. Cl. ..... 174/115; 174/36; 174/117 R

[58] Field of Search ..... 174/36, 115, 116, 117 R, 174/117 F, 113 C, 131 A

[56] References Cited

U.S. PATENT DOCUMENTS

| | | | |
|---|---|---|---|
| 1,940,917 | 12/1933 | Okazaki | 174/113 C |
| 2,403,816 | 7/1946 | Martin | 174/113 C |
| 2,501,457 | 3/1950 | Thelin | 174/116 |
| 2,628,998 | 2/1953 | Frisbie | 174/117 F |
| 3,023,267 | 2/1962 | Rubinstein et al. | 174/115 |
| 3,328,510 | 6/1967 | White | 174/117 R |
| 3,549,788 | 12/1970 | Apen | 174/117 F X |
| 3,715,458 | 2/1973 | Bayes et al. | 174/117 R X |
| 3,829,603 | 8/1974 | Hansen et al. | 174/115 |
| 3,927,247 | 12/1975 | Timmons | 174/115 X |
| 4,268,714 | 5/1981 | Mori | 174/115 X |
| 4,327,246 | 4/1982 | Kincaid | 174/115 X |
| 4,383,725 | 5/1983 | Bogese et al. | 174/117 F X |

FOREIGN PATENT DOCUMENTS

| | | | |
|---|---|---|---|
| 2039870 | 4/1971 | Fed. Rep. of Germany | 174/113 R |
| 308747 | 2/1969 | Sweden | 174/115 |

*Primary Examiner*—A. T. Grimley
*Assistant Examiner*—Morris H. Nimmo
*Attorney, Agent, or Firm*—McCormick, Paulding & Huber

[57] ABSTRACT

A flexible free-stripping composite cable assembly having a plurality of groups of electrical conductors including power supply, telephone and CATV/DATA conductors. Each group of conductors is contained within a distinct portion of a common insulation jacket. The jacket portions are connected by integral webs for hinged flexure relative to each other to facilitate alteration of the cross-sectional configuration of the cable assembly. The power supply conductors are separated by a dielectric spacer and surrounded by a flexible metallic shield which is in electrical contact with an uninsulated one of the power supply conductor throughout a substantial portion of its length.

17 Claims, 4 Drawing Figures

ELECTRICAL CONDUCTOR ASSEMBLY

CROSS REFERENCE TO RELATED APPLICATION

This application is a continuation-in-part of application Ser. No. 466,833, filed Feb. 16, 1983, now abandoned.

BACKGROUND OF THE INVENTION

This invention relates in general to electrical conductor assemblies and deals more particularly with an improved flexible electrical supply cable.

Recent deregulation of the telephone industry has created further opportunity for others to enter the residential and light commercial telephone cable installation market. It is anticipated that telephone companies may be abandoning responsibility for installation and maintenance of telephones as a result of government "unbundling" of pricing for telephone installation and service, since the cost of new construction installation is likely to become prohibitive due to the loss of supporting business revenues derived from service. It is expected that this gap will be filled by the electrical contractor.

Now with the expanding availability of cable television and data service (CATV/DATA) throughout the United States, an additional cable installation, made at a proper time in a new home construction, is highly desirable and, if available, would probably be specified in a large percentage of new housing starts. A properly trained electrician, equipped with adequate tools, should be capable of installing telephone and CATV-/DATA service as well as conventional power supply service.

Heretofore outlet boxes have been available which facilitate single point outlets for power and other service, such as telephone service, for example, however, such systems generally utilize separate cables for each service.

Established electrical codes generally prohibit the presence of electrical supply conductors and electrical conductors for providing other unrelated service, such as a telephone service, within a common insulation jacket, because of potential electrical shock hazards. If a nail or staple is inadvertently driven through such a common jacket and into contact with a normally energized electrical supply conductor and one of the conductors associated with another service, such as, for example, telephone service, the telephone service conductor may acquire the higher voltage potential of the power supply source. The resulting condition presents a potentially serious electrical shock hazard to the telephone installer or user.

It is the general aim of the present invention to provide an improved flexible free-stripping electrical cable assembly which includes within the common jacket power supply conductors and electrical conductors associated with other unrelated service and which overcomes or at least substantially minimizes problems normally associated with such cable arrangement.

A more specific aim of the invention is to provide an improved electrical conductor assembly or cable which enables simultaneous installation of electrical conductors for supplying a plurality of unrelated services and which may be coiled and stored on a reel without kinking the individual conductors which comprise the cable and readily adapted to conform to specific conditions encountered during cable installation.

SUMMARY OF THE INVENTION

In accordance with the invention an electrical cable comprises a plurality of groups of axially elongated flexible electrical conductors including first, second and third groups, each group including at least one electrical conductor. The groups of conductors are contained within a unitary flexible axially elongated jacket of dielectric material which separates and insulates the conductors of each of the groups from the conductors of the other of the groups. The jacket has distinct axially elongated tubular portions which include a first tubular portion containing the conductors of the first group, a second tubular portion containing the conductors of the second group and a third tubular portion containing the conductors of the third group. A plurality of integral axially elongated web portions hingedly connect the tubular portions for movement relative to each other between first and second positions and include first and second web portions integrally connected to the first tubular portion at points of connection angularly spaced generally about the central axis of the first tubular portion. The first web hingedly connects the second tubular portion to the first tubular portion. The second web hingedly connects the third tubular portion to the first tubular portion. The conductors of the first, second and third groups are disposed to one side of a plane which passes through the points of connection and the conductors of the second group are disposed to the opposite sides of the plane when the tubular portions are in the first position. The conductors of each of the groups are disposed to the same side of the plane and in generally side-by-side relation to each other when the tubular portions are in the second portion.

DETAILED DESCRIPTION OF THE PREFERRED EMBODIMENT

Figure 3:
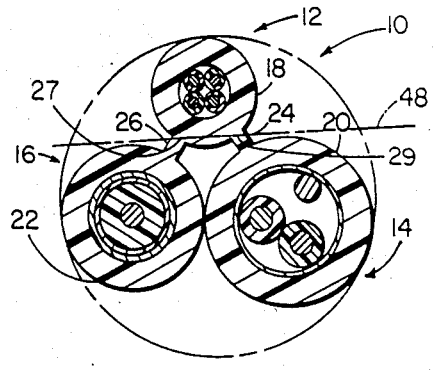
FIG. 3 is similar to FIG. 2 but shows the components which comprise the cable in another position.
Figure 1:
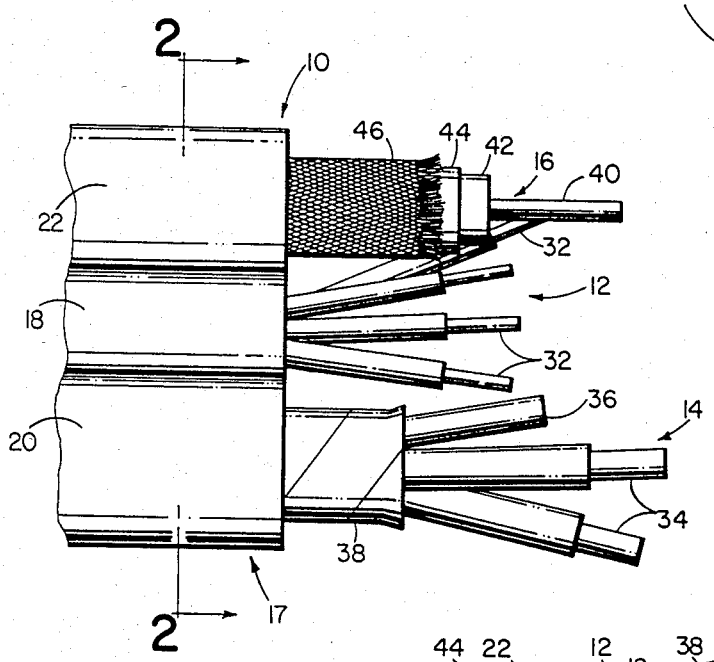
FIG. 1 is a fragmentary plan view of an electrical cable embodying the present invention.

Turning now to the drawing, an axially elongated, flexible electrical conductor assembly embodying the present invention and indicated generally by the reference numeral 10 comprises a composite cable which includes components for providing power, CATV-/DATA and telephone service. The illustrated cable 10 is of a free-stripping type, particularly adapted to facilitate simultaneous installation of electrical conductors essential to the provision of such service and includes three components which comprise groups of electrical conductors designated generally by the numeral 12, 14 and 16. A unitary dielectric insulating jacket, indicated generally at 17, separates and insulates the electrical conductors which comprise each of the groups of conductors from the conductors of the other of the groups of conductors.

The insulation jacket 17 is preferably made from an elastomeric material, has three distinct free-stripping tubular portions each having a generally circular cross section. A first portion of the jacket, indicated by the numeral 18, generally coaxially surrounds the electrical conductors which comprise the first groups of conductors 12. These conductors are particularly adapted to supply telephone service. A second portion of the jacket, indicated by the numeral 20, generally coaxially surrounds the conductors of the second group 14, which constitute power supply conductors. A third portion of the jacket, indicated at 22, coaxially surrounds the third group 16, which comprises a coaxial cable arrangement for CATV/DATA service.

Figure 2:
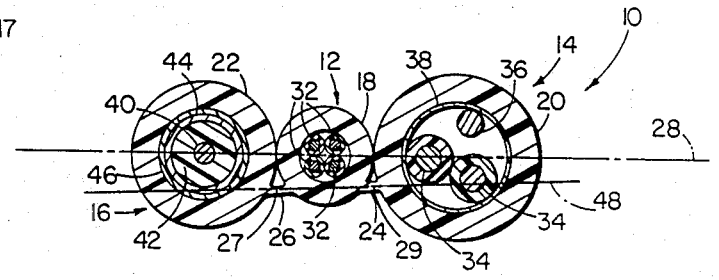
FIG. 2 is a sectional view taken along the line 2—2 of FIG. 1.

The jacket second portion 20 is connected to the first portion 18 along its length by an integral longitudinally extending web 24. A similar web 26 connects the first portion 18 and the third portion 22. Referring particularly to FIG. 2, it should be noted that the webs 24 and 26 are connected to the jacket first portion 18 at points of connection 27 and 29 angularly spaced about the central axis of the first tubular jacket portion 18 and located to one side of an axial plane 28 which contains the axis of the first portion 18. The webs 24 and 26 provide flexible hinge connections as well as regions of weakening between the component parts of the cable 10, for purposes which will be hereinafter further evident.

Considering the various components of the cable 10 in further detail, the conductor group 12, which is particularly adapted to provide telephone service, preferably includes four non-twisted, individually insulated and color coded AWG No. 24 solid wire telecommunications conductors 32, 32.

The power supply component which comprises the conductor group 14 is particularly adapted for residential power supply and includes two insulated and color code AWG No. 14 solid wire conductors 34, 34 and an uninsulated or bare metallic ground conductor 36 contained within a generally cylindrical dielectric sheath defined by the jacket portion 20. The insulated conductors 34, 34 and the bare metallic conductor 36 are surrounded by a spiral wrapping of metallic foil 38. The metallic foil, which is preferably copper, comprises a flexible coaxial sleeve surrounding the conductors of the group 14, is contained within the dielectric insulation sheath 20 and is in immediate or interrupted electrical contacting engagement with the bare metallic conductor 36 along a substantial portion of its length for a purpose which will be hereinafter further evident.

The CATV/DATA component 16 conforms with present industry standards and includes a single AWG No. 20 solid wire conductor 40 coaxially surrounded by a generally cylindrical layer of foam dielectric material 42. A generally cylindrical flexible shield 44, preferably formed by a spiral wrapping of aluminum foil, coaxially surrounds the dielectric layer 42. Another flexible cylindrical shield 46, preferably made from sixty percent aluminum braided wire, coaxially surrounds the shield 44 within the insulation sheath formed by the generally cylindrical jacket portion 22.

The web portions 24 and 26 extend along the length of the cable 10 in generally parallel relation to the longitudinal axis of the cable and form flexible hinges between the components 12, 14 and 16 so that the three components may be positioned with the conductors thereof in generally side-by-side or in line relation, as shown in FIG. 2, to provide a substantially flat cable arrangement wherein the telephone component 12 is disposed generally between the power supply component 14 and the CATV/DATA component 16. In the latter position all of the conductors which comprise the cable 10 are disposed to the same side of a plane, indicated at 48, passing through the points of connection 27 and 29, as shown in FIG. 2. This side-by-side arrangement of the various conductors facilitates coiling or winding the cable 10 on a reel (not shown) which eliminates any substantial risk of kinking conductors. The arrangement of the hinged web connections between the various components is such that the cable 10 may be formed from the cross-sectional configuration shown in FIG. 2 to the cross-sectional configuration shown in FIG. 3 by hinged flexure of the components 14 and 16 at the webs 24 and 26 and relative to the component 12 and to each other, when the cable 10 is pulled from an associated reel. When the cable components are arranged in a generally delta configuration, as shown in FIG. 3, the components 20 and 22 are disposed immediately adjacent each other and the conductors contained therein, which comprise the conductor of the second and third groups 14 and 16 are disposed to one side of the plane 48, whereas the conductors which comprise the first group 12 are disposed to the opposite side of the plane 48. The three components 12, 14 and 16 lie within the boundary of an imaginary circle indicated by broken lines in FIG. 3. This arrangement of the components enables reduction of the major cross-sectional dimension of the cable so that it may pass freely through a circular opening of a predetermined size without encountering substantial frictional resistance. The illustrated cable 10 is paticularly adapted for residential installation and is or may be sized to pass freely through a cylindrical hole of industry standard without substantial frictional resistance.

In addition to shielding the telephone components 12 and the CATV/DATA component 16 from electromagnetic interference, the shield 38 in the power supply component 14 also cooperates with the bare metallic ground conductor 38 to provide an important safety feature. If, during building construction, for example, a metal nail or staple is inadvertently driven through the power supply component and contacts a normally energized conductor, the nail or staple is at ground potential having passed through the metallic shield 38, which is grounded by the ground conductor or wire 36. Thus, the energized conductor will immediately short to ground. If this condition should occur during construction and before the cable is connected to a power source, the system will be shorted when the cable is connected to the power supply source. If the cable is properly handled this arrangement should prevent accidential energization of either the telephone component or the CATV/DATA component by the power supply component when the cable is installed.

If desired, an additional metallic sleeve (not shown) may be provided in the telephone service component 12 within the insulation sheath 18 and in generally coaxially surrounding relation to the conductors 32, 32 to further shield against both conducted and radiated noise interference.

The connecting web portions 24 and 26 comprise weakened regions of the insulation jacket 17 which enable the various free-stripping components 12, 14 and 16 to be readily selectively separated from each other. Thus, either and both of the components 14 and 16 may be readily separated from the component 17 by applying tearing force to end parts of an appropriate two of the three components 12, 14 and 16. The tearing force is, of course, applied in laterally opposite directions relative to the longitudinal axis of the conductor assembly 10.

Figure 4:
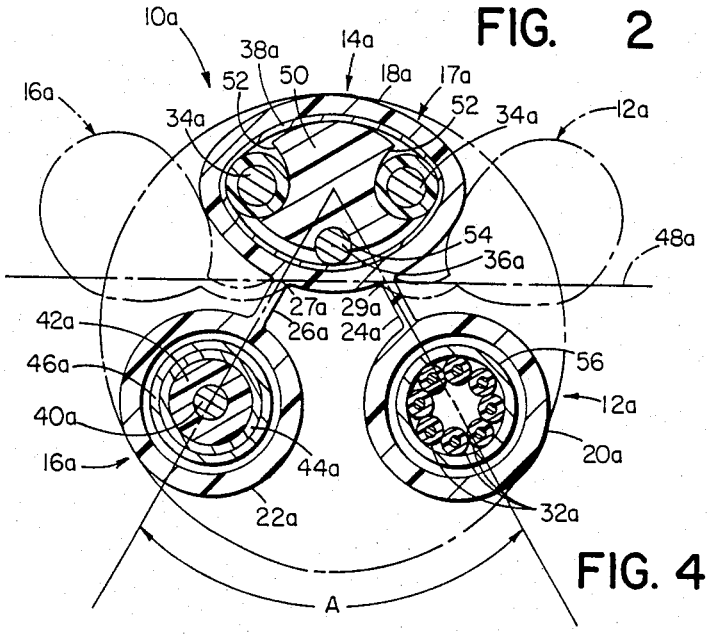
FIG. 4 is similar to FIG. 2 but shows another electrical cable embodying the present invention.

Referring now to FIG. 4, another electrical conductor assembly or cable embodying the present invention is indicated generally at 10*a*. The cable 10*a* is similar in many respects to the cable 10, previously described, and parts of the cable 10*a* which correspond to parts of the cable 10 are identified by the same reference numeral with a letter "a" suffix. The essential differences between the cable 10*a* and the previously described cable 10 reside in the construction of the power supply component and its arrangement relative to the telephone and CATV/DATA components, which will be hereinafter described.

The cable 10*a* has a unitary dielectric insulation jacket indicated generally at 17*a* which includes distinct first, second and third jacket portions indicated respectively at 18*a*, 20*a* and 22*a* connected by webs 24*a* and 26*a* which provide flexible hinge connections between the various jacket portions, substantially as previously described. The illustrated cable 10*a* is a free-stripping type in that the various distinct tubular portions of the jacket 17*a* are not adhered to the components contained therein. Thus, when terminal ends of the tubular jacket portions are removed, the electrical conductors contained therein are exposed and are readily separable from each other and from the surrounding portion of the jacket.

The first jacket portion 18*a* contains a power supply component which comprises a conductor group 14*a* and includes two insulated color coded solid wire conductors 34*a*, 34*a* and an uninsulated or bare metallic ground conductor 36*a*. An axially elongated shaped insulating spacer 50, which preferably comprises a flexible elongated extrusion of dielectric plastic material, is also located within the jacket first portion 18*a* and serves to maintain the conductors 34*a*, 34*a* and 36*a* in generally predetermined spaced apart position relative to each other. As shown, the spacer 50 has axially extending arcuate grooves 52, 52 for receiving and retaining the conductors 34*a*, 34*a* and another arcuate groove 54 for receiving and containing the bare conductor 36*a*. A spiral wrapping of metallic foil 38*a*, preferably copper, is located within the jacket portion 18*a* and surrounds the conductors which comprise the group 14*a*. The jacket portion 18*a* preferably closely surrounds the flexible metallic sleeve 38*a*, the conductors 34*a*, 34*a* and 36*a* and the spacer 50, substantially as shown in FIG. 4. Thus, the tubular jacket portion 18*a* cooperates with the spacer 50 to retain the conductors which comprise the power supply component 14*a* in predetermined spaced relation to each other. Further, the jacket portion 18*a* cooperates with the spacer to maintain the bare metallic conductor 36*a* in substantial uninterrupted electrical contacting engagement with the flexible metallic shield 38*a* along a substantial portion of the length of the bare metallic conductor.

In the illustrated embodiment 10*a* the second jacket portion 20*a* contains a telephone component 12*a* which, as shown, includes eight individually insulated telecommunications conductors 32*a*, 32*a*. The illustrated jacket portion 20*a* also contains a flexible metallic shield 56 formed by a wrapping of metallic foil and surrounding the conductors 32*a*, 32*a*. However, the shield 56 may be omitted, if desired. The third jacket portion 22*a* contains a CATV/DATA component 16*a* substantially identical to the component 16, previously described.

The webs 24*a* and 26*a* are connected to the jacket portion 18*a* at points of connection indicated at 27*a* and 29*a*. The included angle between the points of connection 27*a* and 29*a*, as measured about the central axis of the jacket portion 18*a* and indicated by the letter A in FIG. 4, is preferably at least 60 degrees but not greater than 100 degrees. The length of each web as measured between its point of connection to the jacket portion 18*a* and its point of connection to an associated jacket portion is preferably as short as possible while allowing hinge flexure of the components between the full line and broken line portions of FIG. 4.

The outer jacket 17*a* preferably comprises an extruded plastic material, being preferably extruded in the form in which it appears in full lines in FIG. 4, wherein the three service components are maintained in a Delta cross-sectional configuration relative to each other. In the latter position the three components lie within an imaginary circle, such as shown in broken lines in FIG. 4, which may, for example, represent a typical opening through which the cable 10*a* may be pulled. When the cable 10*a* is in the position shown in FIG. 4, the second and third groups of electrical conductors 12*a* and 16*a* are disposed to one side of an imaginary plane 48*a* passing through the points of connection 27*a* and 29*a*. The conductors which comprise the first group 14*a* are disposed to the opposite of the plane 48*a*. When the jacket 18*a* and 22*a* portions are flexed about the webs 24*a* and 26*a* and to their respective broken line positions of FIG. 4, all of the conductors which comprise the first, second and third groups of conductors are generally disposed to the same side of the plane 48*a* and lie in generally side-by-side or in-line relation to each other so that the cable 10*a* may be would onto a reel (not shown) or the like with each of the conductors being wound to approximately the same radius as the others, whereby the risk of kinking the various conductors is minimized.

The cable of the present invention facilitates cost-saving installation of power, video/computer and telephone service wiring. The telephone component facilitates the installation of many circuits for miscellaneous control, monitor or audio applications, as may be required.

The invention has been illustrated with reference to cable assemblies having particular arrangements of electrical conductors, however, it should be understood the size, number and type of electrical conductors which comprise the various cable components may vary and that further modified forms of the cable are contemplated within the scope of the invention.

We claim:

1. An electrical cable comprising a plurality of groups of axially elongated flexible electrical conductors including first, second and third groups, each of said groups including at least one electrical conductor, and a unitary flexible axially elongated jacket of dielectric material separating and insulating said conductors of each of said groups from said conductors of the other of said groups, said jacket having distinct axially elongated tubular portions including a first tubular portion containing said conductors of said first group, a second tubular portion containing said conductors of said second group and a third tubular portion containing said conductors of said third group, a plurality of integral axially elongated web portions hingedly connecting said tubular portions for movement relative to each other between a first position and a second position and including first and second web portions integrally connected to said first tubular portion at points of connection angularly spaced generally about the central axis of said first tubular portion, said first web hingedly connecting said second tubular portion to said first tubular portion, said second web hingedly connecting said third tubular portion to said first tubular portion, said conductors of said second and third groups being disposed to one side of a plane passing through said points of connection and said conductors of said first group being disposed to the opposite side of said plane when said tubular portions are in said first position, said conductors of said first group, said second group and said third group being disposed to the same side of said plane when said tubular portions are in said second position, said first and second web portions cooperating with said tubular portions to maintain said tubular portions in generally side-by-side relation to each other with said first tubular portion disposed between said second tubular portion and said third tubular portion and with said second tubular and said third tubular portion in adjacent contacting engagement with said first tubular portion when said tubular portions are in said second portion.

2. An electrical cable as set forth in claim 1 wherein at least one of said groups includes a plurality of electrical conductors and said cable includes an axially elongated spacer contained with an associated one of said tubular portions containing the conductors of said at least one group, said spacer cooperating with said associated one tubular portion to retain the conductors of said at least one group in spaced apart relation to each other.

3. An electrical cable as set forth in claim 2 wherein said cable includes an axially elongated flexible metallic sleeve contained within said associated one tubular portion and said sleeve contains said spacer and the conductors of said at least one group.

4. An electrical cable as set forth in claim 3 wherein one of the conductors in said at least one group comprises a bare metal conductor and said spacer and said one tubular portion cooperates to retain said associated one bare metal conductor in generally contacting engagement with said metallic sleeve along a substantial portion of the length of said bare metal conductor.

5. An electrical cable as set forth in claim 3 wherein said sleeve comprises a spiral wrapping of copper foil.

6. An electrical cable as set forth in claim 3 including another flexible metallic sleeve contained within another of said tubular portions containing the conductor of another of said groups and said another metallic sleeve generally coaxially surrounds the conductors of said another of said groups.

7. An electrical cable as set forth in claim 1 wherein the included angle between said angularly spaced points of connection is at least 60 degrees and not greater than 100 degrees.

8. An electrical cable as set forth in claim 7 wherein said included angle comprises approximately 60 degrees.

9. An electrical cable as set forth in claim 1 wherein said webs normally maintain said tubular portions in said first position.

10. A conductor assembly comprising first, second and third groups of axially elongated flexible electrical conductors, each of said groups including at least one electrical conductor, and a unitary axially elongate flexible free stripping jacket of dielectric material isolating the conductors of each of said groups from the conductors of the other of said groups, said jacket having a distinct free-stripping portions including a first portion containing said first group, a second portion containing said second group, and a third portion containing said third group, an elongated first web extending in generally parallel relation to the axis of said conductor assembly and connected at a first point of connection to said first portion, said first web hingedly connecting said second portion in parallel spaced relation to said first portion, an elongated second web extending in axially parallel relation to the axis of said conductor assembly and connected at a second point of connection to said first portion, said second web hingedly connecting said third portion in parallel spaced relation to said first portion, said second and third portions being hingedly movable relative to each other and to said first portion about axes of flexure defined by said first and second webs between a first portion wherein the conductors of said second and third groups are disposed to one side of a plane passing through said points of connection and the conductors of said first group are disposed to the opposite side of said plane and a second position wherein said first and second webs cooperate with said first portion, said second portion and said third portion to maintain said second portion and said third portion in adjacent side-by-side relation to said first portion and said first group, said second group and said third group in in-line relation with each other at the same side of said plane.

11. An electrical conductor assembly as set forth in claim 10 wherein either and both said second and third portions are separable from said first portion and from each other in response to tearing force applied to end parts of two of said portions in laterally opposite directions relative to the axis of said conductor assembly.

12. An electrical conductor assembly as set forth in claim 10 wherein one of said groups comprising said first, second and third groups includes a plurality of individually insulated electrical conductors and an uninsulated electrical conductor and said assembly includes a flexible metallic sleeve coaxially surrounding the conductors of said one of said groups in general electrical contacting engagement with said uninsulated conductor along a substantial portion of the length of said uninsulated conductor.

13. An electrical cable assembly comprising a unitary flexible free-stripping electrical insulation jacket and a plurality of separate cable components contained with separate free-stripping generally cylindrical tubular portions of said jacket and including a flexible power supply component contained with a first portion of said jacket and having a plurality of individually insulated power supply conductors and a ground conductor, a flexible telephone supply component contained with a second portion of said jacket and including a plurality of individually insulated telephone service conductors, and a flexible television/data cable component contained within a third portion of said jacket and including a single electrical conductor, a layer of electrical insulating material coaxially surrounding said single conductor, and a second metallic sleeve coaxially surrounding said layer of insulating material, said jacket including a plurality of webs connected to one of the portions comprising said first, second and third portions of said jacket at points of connection angularly spaced about the axis of said one of said portions and to the other of the portions of said jacket for hinged flexure between one position wherein said one of the portions is disposed generally intermediate said other of the portions and in tangential contact with said other of the portions and all of the cable components are disposed to the same side of a plane parallel to the axis of said cable and extending generally through said points of connection and another position wherein said cable components contained within said one of said portions and the cable components contained within said other of said portions are located at opposite sides of said plane.

14. An electrical cable assembly as set forth in claim 13 wherein said webs define regions of weakening along which one of said components is selectively separable from either and both of the other of said components in response to tearing force applied to end parts of two of said components in generally laterally opposite directions relative to the axis of said cable assembly.

15. An electrical cable assembly as set forth in claim 13 wherein said first of said portions comprises said one portion.

16. An electrical cable assembly as set forth in claim 13 including a dielectric spacer disposed within said first portion and separating said power supply conductors from each other and from said ground conductor.

17. An electrical cable comprising a plurality of groups of axially elongated flexible conductors including first, second and third groups, each of said groups including at least one conductor, and a unitary flexible axially elongated jacket of dielectric material isolating said conductors of each of said groups from said conductors of the other of said groups, said jacket having distinct axially elongated tubular portions including a first tubular portion containing said conductors of said first group, a second tubular portion containing said conductors of said second group and a third tubular portion containing said conductors of said third group, a plurality of integral axially elongated web portions hingedly connecting said tubular portions for movement relative to each other between a first position and a second position and including first and second web portions integrally connected to said first tubular portion at points of connection angularly spaced generally about the central axis of said first tubular portion, said first web hingedly connecting said second tubular portion to said first tubular portion, said second web hingedly connecting said third tubular portion to said first tubular portion, said conductors of said second and third groups being disposed to one side of a plane passing through said points of connection and said conductors of said first group being disposed to the opposite side of said plane when said tubular portions are in said first position, said conductors of each of said groups being disposed to the same side of said plane and in immediately adjacent side-by-side relation to each other when said tubular portions are in said second position.

* * * * *